US011486029B2

(12) United States Patent
Li et al.

(10) Patent No.: US 11,486,029 B2
(45) Date of Patent: Nov. 1, 2022

(54) PRECIPITATION-STRENGTHENED COPPER ALLOY AND APPLICATION THEREOF

(71) Applicant: NINGBO POWERWAY ALLOY MATERIAL CO., LTD., Zhejiang (CN)

(72) Inventors: Jiangang Li, Zhejiang (CN); Taisheng Yang, Zhejiang (CN); Hongbin Zhao, Zhejiang (CN); Chaoyong Yang, Zhejiang (CN); Yaohua Zhou, Zhejiang (CN); Qiang Huang, Zhejiang (CN)

(73) Assignee: NINGBO POWERWAY ALLOY MATERIAL CO., LTD., Zhejiang (CN)

( * ) Notice: Subject to any disclaimer, the term of this patent is extended or adjusted under 35 U.S.C. 154(b) by 253 days.

(21) Appl. No.: 16/490,562

(22) PCT Filed: Feb. 12, 2018

(86) PCT No.: PCT/CN2018/000074

§ 371 (c)(1),
(2) Date: Sep. 1, 2019

(87) PCT Pub. No.: WO2019/148304

PCT Pub. Date: Aug. 8, 2019

(65) Prior Publication Data

US 2020/0071805 A1 Mar. 5, 2020

(30) Foreign Application Priority Data

Jan. 31, 2018 (CN) ..... 201810093760.X

(51) Int. Cl.

| | |
|---|---|
| ***C22F 1/08*** | (2006.01) |
| ***C22C 9/04*** | (2006.01) |
| ***H01B 1/02*** | (2006.01) |

(52) U.S. Cl.
CPC ..... *C22F 1/08* (2013.01); *C22C 9/04* (2013.01); *H01B 1/026* (2013.01)

(58) Field of Classification Search
CPC ... C22F 1/08; C22F 1/002; C22C 9/04; C22C 9/02; C22C 9/06; H01B 1/026
See application file for complete search history.

(56) References Cited

U.S. PATENT DOCUMENTS 6,334,915 B1 * 1/2002 Ogura ..... C22C 9/06 148/435
8,784,580 B2 * 7/2014 Fugono ..... C22F 1/00 148/435

(Continued)

FOREIGN PATENT DOCUMENTS

CN 101605917 12/2009
CN 103361512 10/2013

(Continued)

OTHER PUBLICATIONS

"International Search Report (Form PCT/ISA/210) of PCT/CN2018/000074," dated Oct. 18, 2018, pp. 1-5.

(Continued)

*Primary Examiner* — John A Hevey
(74) *Attorney, Agent, or Firm* — JCIP Global Inc.

(57) ABSTRACT

The invention is a precipitation-strengthened copper alloy, including the following components in percentage by weight: 80 wt %-95 wt % of Cu, 0.05 wt %-4.0 wt % of Sn, 0.01 wt %-3.0 wt % of Ni, 0.01 wt %-1.0 wt % of Si, and the balance of Zn and unavoidable impurities. According to the invention, the comprehensive performance of the alloy is improved by solution strengthening and precipitation strengthening; while the strength of the matrix is improved, the electrical conductivity of the alloy is hardly affected, the bending workability meets the requirements, and the stress relaxation resistance comparable to that of tin phosphor (Continued)

bronze is achieved. The comprehensive performance of the alloy of the invention is superior to that of the tin phosphor bronze C51900. Furthermore, the alloy of the invention is low in raw material cost, has obvious advantages in welding and plating.

7 Claims, 1 Drawing Sheet

(56) References Cited

U.S. PATENT DOCUMENTS

| | | | | |
|---|---|---|---|---|
| 2004/0234412 | A1 | 11/2004 | Oishi et al. | |
| 2015/0000803 | A1* | 1/2015 | Kumagai | C22F 1/08 148/682 |
| 2016/0040270 | A1 | 2/2016 | Katsura | |
| 2018/0066339 | A1* | 3/2018 | Li | C22C 9/04 |
| 2019/0264313 | A1* | 8/2019 | Higami | H01B 13/00 |
| 2021/0062301 | A1* | 3/2021 | Yang | C22C 9/02 |

FOREIGN PATENT DOCUMENTS

| | | |
|---|---|---|
| EP | 2728025 | 5/2014 |
| EP | 2796577 | 10/2014 |
| JP | 2004285449 | 10/2004 |

OTHER PUBLICATIONS

Rwg Wyckoff, "Copper Diffraction data computed using the structure from the paper listed below, along with the cell parameters refined from the powder pattern for R061078", Structures American Mineralogist, Dec. 31, 1963, p. 1.

"Search Report of Europe Counterpart Application", dated Aug. 27, 2021, p. 1-p. 11.

* cited by examiner

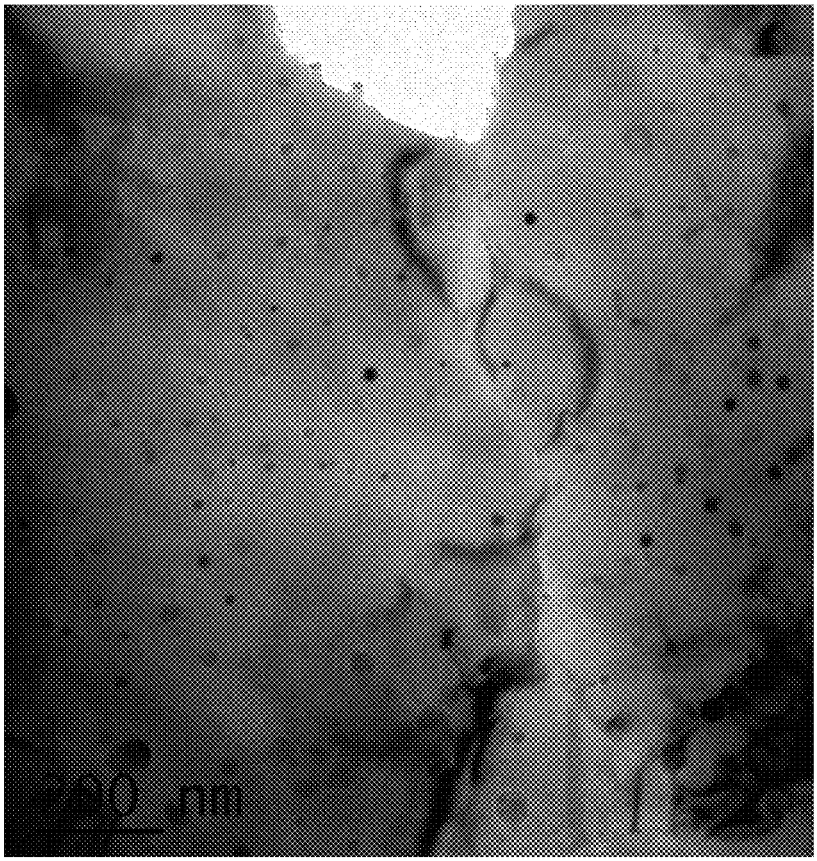
60 nm

PRECIPITATION-STRENGTHENED COPPER ALLOY AND APPLICATION THEREOF

CROSS-REFERENCE TO RELATED APPLICATION

This application is a 371 of international application of PCT application serial no. PCT/CN2018/000074, filed on Feb. 12, 2018, which claims the priority benefit of China application no. 201810093760.X, filed on Jan. 31, 2018. The entirety of each of the above mentioned patent applications is hereby incorporated by reference herein and made a part of this specification.

BACKGROUND

Technical Field

The invention relates to the technical field of copper alloys, in particular to a precipitation-strengthened copper alloy with high strength and application thereof.

Description of Related Art

In recent years, with the development of the electronic and electrical industries, various mechanical and electrical wirings have become complicated and highly integrated, and the requirements for further lightweighting and reliability of electrical and electronic components such as connectors, relays, and switches are drawing more and more attentions. In particular, connectors, sockets and the like used in tablet computers and mobile phones are required to be space-saving and high-performance at the same time. The thickness of copper alloy strips is required to be thinner, and higher requirements are put on the elasticity and reliability of copper alloys. Specifically, the miniaturization and thinning require improvement in the strength and elasticity of the material, and the shape complexity of parts requires improvement in the stamping workability and bending workability of the material, an increase in the amount of electricity per unit sectional area and an increase in the speed of the electric signal require improvement in electrical conductivity. In addition, depending on the different applications, some products have increased requirements for plating of Sn, Au, Ag, etc., and some products have increased requirements for welding. Therefore, there is a high requirement for plating adhesion or weldability of materials. In some fields of connectors where the ambient temperature is required, the stress relaxation resistance of the material must also be met.

Currently, materials commonly used in connectors, terminals, relays, switches, etc., used for electrical and electronic devices are brass (C28000), phosphor bronze (C51900 and C52100), beryllium bronze (C17200 and C17530), and copper alloys such as copper-nickel-silicon copper alloys (C19010, C70250, and C70350), which can meet different requirements for properties of copper alloys in different fields. One example is brass C28000 of which the tensile strength is about 450 MPa and the electrical conductivity is about 25% IACS. Brass C28000 can meet the requirements of common connectors and terminals for material properties, but especially in the field where high stress relaxation resistance is required, the lack of comprehensive performance of brass is very obvious. Phosphor bronze is a copper alloy widely used in connectors and terminals. Sn contained in phosphor bronze has a solution strengthening effect, and moreover, cold deformation hardening makes phosphor bronze have higher strength; however, Sn affects the electrical conductivity of phosphor bronze, and the electrical conductivity of phosphor bronze is generally below 20% IACS; in addition, the price of Sn is relatively high. Therefore, the application of phosphor bronze is limited to some degree. Beryllium contained in beryllium bronze is toxic, and beryllium bronze is expensive and is generally only used in certain fields where high elasticity and strength are required. As an aging precipitation strengthened alloy, the copper-nickel-silicon alloy is developed to replace beryllium bronze, but due to high processing cost, the copper-nickel-silicon alloy is usually applied to the field of high-end connectors which have high requirements for strength and electrical conductivity.

SUMMARY

The technical problem to be solved by the invention is to provide a precipitation-strengthened copper alloy excellent in comprehensive performance including yield strength, electrical conductivity, bending workability, and stress relaxation resistance, and application thereof, in view of the deficiencies of the prior art.

The technical solution adopted by the invention to solve the above-mentioned technical problem is: a precipitation-strengthened copper alloy, including the following components in percentage by weight: 80 wt %-95 wt % of Cu, 0.05 wt %-4.0 wt % of Sn, 0.01 wt %-3.0 wt % of Ni, 0.01 wt %-1.0 wt % of Si, and the balance of Zn and unavoidable impurities.

According to the invention, elements Ni, Si, and Sn are added to the matrix of the copper alloy; on one hand, the strength of the alloy is improved by solution strengthening, and on the other hand, by NiSi phase precipitation strengthening, the strength of the matrix is improved, and moreover the electrical conductivity of the alloy is hardly affected, the bending workability meets the requirements, and the stress relaxation resistance comparable to that of tin phosphor bronze is achieved; the comprehensive performance of the alloy of the invention is superior to that of the tin phosphor bronze C51900. Furthermore, the alloy of the invention is added with elements such as Zn and Sn. In addition to cost saving, it has obvious advantages in welding and plating.

The effect of adding Sn to the copper alloy of the invention is to improve the strength and elasticity of the alloy, and to improve the stress relaxation resistance (heat resistance) of the alloy in an environment of about 150° C. Therefore, Sn is a useful additive element for materials for electric components. However, when the Sn content is less than 0.05 wt %, the effect of improving the properties of the alloy is not satisfactory; when the Sn content exceeds 4.0 wt %, the electrical conductivity of the alloy is greatly lowered, and therefore, the invention controls the Sn content to be within a range of 0.05 wt % to 4.0 wt %.

The addition of the element Zn is added to the copper alloy of the invention; on one hand, Zn has a solution strengthening effect, and the strength of the matrix can be improved. On the other hand, Zn can obviously improve the wettability and tin plating adhesion of solder necessary for electrical and electronic component materials. In addition, Zn is less expensive than other elements and inexpensive brass scrap can be used as a raw material source of Zn in the copper alloy of the invention. If the Zn content is too low, the effect of solution strengthening is not significant, and the recycling of brass scrap is limited; and if the Zn content is too high, the electrical conductivity, bending workability and stress corrosion resistance of the alloy are lowered.

In addition to brass scrap, other scraps, such as nickel-plated scrap from connectors for personal computers and mobile phones, tin-plated scrap from automotive-oriented connectors, and automotive-oriented tin-plated brass scrap may also can be recycled and used in the copper alloy of the invention. The use of the above-mentioned scraps in the copper alloy of the invention can effectively reduce the alloy preparation cost and promote the recycling of scraps.

A certain amount of Ni is added to the copper matrix, and Ni can enhance the strength of the matrix by solution strengthening. However, the more important role of Ni in the copper alloy of the invention is to form a NiSi phase with Si, which does not lower the electrical conductivity of the alloy while improving the strength. If the Ni content is less than 0.01 wt %, the strength of the alloy is not improved obviously; when the Ni content exceeds 3.0 wt %, the NiSi phase cannot be completely precipitated, thereby affecting the electrical conductivity of the alloy and causing a disadvantageous effect for bending workability. Therefore, the Ni content in the invention is controlled to be 0.01 wt % to 3.0 wt %.

The addition of Si in the invention is mainly to form a NiSi compound with Ni to enhance the strength of the alloy; since excess Si reduces the electrical conductivity of the alloy, the invention controls the Si content to be 0.01 wt % to 1 wt % so that Si can exist in the form of the NiSi phase as much as possible.

Conventional brass increases the strength of the matrix by solution strengthening, so its strength is limited. For example, C28000 has a tensile strength of about 450 MPa. The copper alloy of the invention contains a NiSi phase, and after aging, the amount of the NiSi phase precipitates having a particle diameter of 50 nm or less accounts for 75% or above of the total amount of the NiSi phase precipitates. A small amount of Ni and Si added to the alloy of the invention can form NiSi phase precipitates, and precipitation of the NiSi phase can significantly increase the yield strength of the alloy. The inventors of the present application have found through extensive experiments that the finer and the more dispersive the precipitates are, the higher the strength of the alloy is; if precipitates are coarse, a weak interface is easily generated, which causes cracking when the alloy strip is bent; if the precipitates are too segregated, local stress concentration will be caused easily, which also causes cracking when the alloy strip is bent. Further, the inventors of the present application also have found that the fine and dispersed NiSi phase precipitates are contributive to the bending workability of the alloy strip, and also hinders the dislocation motion in the stress relaxation process, thereby improving the stress relaxation resistance of the alloy strip. After aging of the copper alloy of the invention, the amount of the NiSi phase precipitates having a particle diameter of 50 nm or less accounts for 75% or above of the total amount of the NiSi phase precipitates, and the NiSi phase precipitates are distributed dispersively, thus ensuring that the yield strength of the alloy strip of the invention is 600 MPa or above, and the conductivity is 20% IACS or above, and also ensuring that the value of the 90° bending workability (R/t) of the copper alloy strip in the GW direction is less than or less than 1, and the value of R/t in the BW direction is less than or equal to 2.

The X-ray diffraction crystal faces of the copper alloy strip of the invention in the range of $0<2\theta<90°$ mainly include {111}, {200}, {220} and {311}, and the X-ray diffraction intensity of the crystal faces{111}, {200}, {220} and {311} is related to the state of the strip. After the strip is cold-rolled and deformed, the diffraction intensity of the crystal faces {111} and {220} will gradually increase, and the diffraction intensity of the crystal faces {200} and {311} will gradually decrease. After the strip is subjected to heat treatment, the diffraction intensity of the crystal faces {200} and {311} will gradually increase, and the diffraction intensity of the crystal faces {111} and {220} will gradually decrease. The increase of the diffraction intensity of the crystal faces {111} and {220} is conducive to the increase of the strength of the strip, but it is not favorable for the bending workability of the strip; the increase of the diffraction intensity of the crystal faces {200} and {311} is favorable for the improvement of the bending workability, but when the diffraction intensity of its crystal faces are large, the strength of the alloy strip is relatively low. If the yield strength of the alloy of the invention is to be 600 MPa or above, it is necessary to apply cold rolling deformation to the alloy after aging, but to ensure good bending workability of the strip (in 90° bending test, the R/t value in the GW direction is less than or equal to 1 and the value of R/t in the BW direction is less than or equal to 2), the rolling deformation of the alloy strip after the aging needs to be controlled. The inventors of the present application have found through extensive experiments that the diffraction intensity of the crystal faces{111}, {220}, {200}, and {311} is one of the key control points affecting the yield strength and bending workability of the alloy. The X-ray diffraction intensity of the crystal face {111}, having a rolled surface within a range of $0<2\theta<90°$, of a strip of the copper alloy is denoted as $I_{\{111\}}$, the X-ray diffraction intensity of the crystal face {200} is denoted as $I_{\{200\}}$, the X-ray diffraction intensity of the crystal face{220} is denoted as $I_{\{220\}}$, and the X-ray diffraction intensity of the crystal face {311} is denoted as I{311}. When $(I_{\{111\}}+I_{\{220\}})/(I_{\{200\}}+I_{\{311\}})<0.5$, the yield strength of the alloy is 600 MPa or below, and in the 90° bending test, the value of R/t in the GW direction is less than or equal to 1, the value of R/t in the BW direction is less than or equal to 2. When $(I_{\{111\}}+I_{\{220\}})/(I_{\{200\}}+I_{\{311\}})>10$, although the yield strength of the alloy is 600 MPa or above, the value of R/t in the BW direction in the 90° bending test is greater than 2, and the bending workability does not reach the requirement. Therefore, in order to consider both the yield strength and the bending workability, the invention defines that $I_{\{111\}}$, $I_{\{200\}}$, $I_{\{220\}}$, and $I_{\{311\}}$ satisfy: $0.5<(I_{\{111\}}+I_{\{220\}})/(I_{\{200\}}+I_{\{311\}})<10$.

The alloy of the invention may further contain 0.01 wt %-2.0 wt % of Co.

Co and Si are simultaneously added to form a cobalt-silicon intermetallic compound, and Co and Si are precipitated as a compound by a solution and aging process, and are dispersed and distributed on the matrix to further increase the strength of the alloy without lowering the electrical conductivity. When the Co content exceeds 2.0 wt %, the hot workability of the material deteriorates, and when the Co content is less than 0.01 wt %, a sufficient amount of precipitate cannot be formed to improve the material properties. Therefore, the invention controls the Co content to be within a range of 0.01 wt % to 2.0 wt %.

The alloy of the invention may further contain 0.01 wt %-2.0 wt % of Fe or 0.001 wt %-1.0 wt % of P.

The role of Fe is to refine the alloy grains. A trace amount of Fe can also increase the strength of the alloy. When the Fe content is too large, the electrical conductivity of the alloy is adversely affected. Therefore, the invention controls the Fe content to be within a range of 0.01 wt % to 2.0 wt %.

P can effectively perform deoxidation, increase the fluidity of the alloy melt, and further improve the strength, hardness, elastic modulus, fatigue strength and wear resistance of the alloy. However, if excess P is added, the electrical conductivity of the alloy will be lowered seriously, and a low-melting eutectic phase $Cu_3P$ is easily formed, causing the alloy to be cracked during hot rolling. Therefore, the invention controls the content of P to be within a range of 0.001 wt % to 1.0 wt %.

The weight percentage composition of the copper alloy may further include at least one element of Mg, B, Re, Cr, and Mn in a total amount of not more than 2.0 wt %, wherein Mg: 0.005 wt %-1.5 wt %, B: 0.0005 wt %-0.3 wt %, Re: 0.0001 wt %-0.1 wt %, Cr: 0.01 wt %-1.5 wt %, and Mn: 0.001 wt %-0.8 wt %.

Mg, B, and Re can inhibit the grain boundary reaction, reduce the number of Ni—Si and Co—Si precipitates distributed on the grain boundary, reduce the hardness of the alloy after solution treatment, and improve the subsequent cold workability. B also can improve the dezincification resistance of the alloy and improve corrosion resistance. B and Mg also can improve the stress relaxation resistance of the alloy and improve the hot and cold workability of the alloy. Re has the effects of impurity removal and deoxidization during smelting, thus improving the purity of metal; moreover, with a high melting point, rare earth can be used as the core of crystallization during smelting, to reduce the columnar crystal content in a ingot and increase the content of equiaxed crystals, thus improving the hot workability of the metal. When the Re content is less than 0.0001 wt %, the above-mentioned effects cannot be achieved. When the content of rare earth exceeds 0.1 wt %, high-temperature oxide inclusions are formed to deteriorate the properties of the alloy. Therefore, the control ranges of Mg, B and Re in the invention are as follows, respectively: Mg: 0.005 wt %-1.5 wt %, B: 0.0005 wt %-0.3 wt %, and Re: 0.0001 wt %-0.1 wt %.

Cr can improve the softening temperature and high-temperature strength of the alloy, improve the high-temperature stability of the alloy, and reduce the stress relaxation rate of the alloy. When the Cr content is less than 0.01 wt %, its effect is not obvious. When the Cr content exceeds 1.5 wt %, the electrical conductivity and the workability of the alloy are deteriorated. Therefore, the invention controls the Cr content to be within a range of 0.01 wt % to 1.5 wt %.

Mn can take an effect of deoxidization during the smelting process so as to improve the purity of the alloy. Mn also can improve the hot workability of the alloy, improve the basic mechanical properties of the alloy, and reduce the elastic modulus of the alloy. When the Mn content is less than 0.001 wt %, the above-mentioned effects cannot be achieved, and when the Mn content exceeds 0.8 wt %, the electrical conductivity and the elastic modulus will be reduced seriously, and thus the use requirements of the alloy cannot be reached.

The alloy of the invention is kept at 150° C. for 1000 hours, and the residual stress is 70% or above. As a copper alloy for connectors, in addition to the need to meet the strength and electrical conductivity, in some cases where the operating ambient temperature is required, the stress relaxation resistance is also a key factor for evaluating the comprehensive performance of the alloy. For example, the brass C28000 with poor stress relaxation resistance adopts a Cu—Zn matrix. After the brass C28000 be kept at 150° C. for 1000 hours incubation, its residual stress is about 35%. After tin phosphor bronze C51900 is kept at 150° C. for 1000 hours, its residual stress is about 60%. However, in the invention, the percentage of the amount of the NiSi phase precipitates having a particle diameter of 50 nm or less in the total amount of the NiSi phase precipitates after aging is controlled to be 75% or higher, and the presence of the NiSi phase precipitates acts as a pinning hindrance to the dislocation motion in the stress relaxation process; the dispersed distribution of the NiSi phase precipitates can improve the stability of the stress relaxation resistance of the alloy and impart superior stress relaxation resistance to the alloy of the invention.

The copper alloy of the invention can be machined into strips, bars, wires and the like according to different application requirements, as to be applied to the electronic and electrical industries.

The copper alloy of the invention can be machined into strips, bars, wires and the like according to different application requirements. Taking the plate strip as an example, its preparation method may be any one of the following two methods.

Method 1: batching→melting→hot rolling→face milling→primary cold rolling→primary aging→secondary cold rolling→secondary aging→pre-cold rolling→low-temperature annealing→cleaning→striping→packaging.

Method 2: batching→horizontal continuous casting→face milling→primary cold rolling→solution treatment→secondary cold rolling→aging treatment→pre-cold rolling→low-temperature annealing→cleaning→striping→packaging.

The melting temperature is within a range of 1080° C. to 1280° C., and the casting method is semi-continuous casting or horizontal continuous casting.

Hot rolling: In order to ensure the re-dissolution of the coarse precipitate phases existing in an ingot, the hot rolling temperature of the alloy is controlled to be within a range of 750° C. to 900° C., and the temperature holding time is 1-6 h. The alloy can be homogenized under this process. In order to minimize the precipitation of phase particles after hot rolling, the final rolling temperature of the alloy is controlled to be 650° C. or above, and on-line water cooling is carried out after hot rolling. The rolling reduction rate is controlled to be 85% or above.

Face milling: After hot rolling, the surface oxide scale is thick, and the upper and lower faces of the hot rolled plate are milled by 0.5 mm-1.0 mm.

Primary cold rolling: The total reduction ratio of cold rolling is controlled to be 80% or above, which is favorable for the later solution treatment to form an ideal recrystallized structure.

Primary aging treatment: the primary aging can achieve the purpose of precipitation of the second phase and structure softening. The primary aging temperature is controlled to be within a range of 400° C. to 600° C., and the time is 3-20 h.

Secondary cold rolling: The rolling reduction ratio is controlled to be within a range of 60% to 85%. Applying cold deformation after solution treatment is favorable for the precipitation of the NiSi phase, which can significantly increase the strength of the alloy. If the deformation is too small, it is not conducive to the completion of recrystallization in the post-aging structure, which is disadvantageous for the bending process of the plate strip.

Secondary aging: the secondary aging temperature is controlled to be within a range of 350° C.-550° C. Aging treatment is the key process for the precipitation strengthening of the alloy. A high temperature is conducive to the complete recrystallization of the structure and the precipitation of the second phase. However, if the aging temperature is too high, the overaging problem is likely to occur, which is not conducive to the strength increase of the alloy.

Low-temperature aging is not conducive to the recrystallization of the strip or the precipitation of the second phase, and has a great influence on the bending process of the strip. Therefore, the aging temperature of the alloy of the invention is controlled to be within a range of 350° C. to 550° C.

Pre-cold rolling: The rolling reduction rate is controlled to be 40% or below. Applying cold deformation to the alloy after aging is favorable for the further improvement of the strength of the strip, but the deformation should not be too large, and too large deformation may cause the recrystallized structure to be completely broken, which is not conducive to the bending workability of the strip.

Low-temperature annealing: The temperature of the low-temperature annealing is within a range of 150° C. to 300° C. For copper alloys with a higher zinc content, low-temperature annealing after cold deformation is favorable for the improvement of strength, especially for the improvement of yield strength, and also can release certain residual stress. The temperature of the low-temperature annealing is controlled to be within the range of 150° C.-300° C. If the temperature is too high, the purpose of strengthening will not be achieved.

Compared with the prior art, the invention has the following advantages:

(1) The alloy of the invention is mainly directed to the deficiency of the comprehensive performance of the copper alloy and the higher cost and electrical lower conductivity of the phosphor bronze. According to the invention, elements Ni, Si, and Sn are added to the matrix of the copper alloy; on one hand, the strength of the alloy is improved by solution strengthening, and on the other hand, by NiSi phase precipitation strengthening, the strength of the matrix is improved, and moreover the electrical conductivity of the alloy is hardly affected, the bending workability meets the requirements, and the stress relaxation resistance comparable to that of tin phosphor bronze is achieved; the comprehensive performance of the alloy of the invention is superior to that of the tin phosphor bronze C51900. Furthermore, the alloy of the invention is added with elements such as Zn and Sn. In addition to cost saving, it has obvious advantages in welding and plating.

(2) The invention controls the dispersed distribution of the NiSi phase, and controls the critical control point, i.e., controls the percentage of the amount of NiSi phase precipitates having a particle diameter of 50 nm or less in the total amount of the NiSi phase precipitates to be 75% or above, thereby realizing excellent comprehensive performance of the copper alloy, including yield strength, electrical conductivity, bending workability and stress relaxation resistance.

(3) After aging, cold rolling deformation, and low-temperature annealing, the copper alloy of the invention can achieve a yield strength of 600 MPa or above and an electrical conductivity of 20% IACS or above; the 90° bending workability of a strip of the copper alloy is as follows: the value of R/t in the GW direction is less than or equal to 1, the value of R/t in the BW direction is less than or equal to 2; after the copper alloy is kept at 150° C. for 1000 hours, its residual stress is 70% or above, and excellent stress relaxation resistance is achieved.

(4) The alloy of the invention can solve the utilization problem of various craps, such as brass scrap, nickel-plated scrap from connectors for personal computers and mobile phones, tin-plated scrap from automotive-oriented connectors, and automotive-oriented tin-plated brass scrap, which is conducive to saving energy, reducing consumption, reducing alloy preparation cost, and promoting recycling of craps.

(5) The alloy of the invention can be machined into products such as rods, wires, plates and strips, and is widely used in products in the electronic and electrical industries, such as connectors and plug-sockets.

BRIEF DESCRIPTION OF THE DRAWINGS

FIG. 1 is a TEM photograph (10000×) of a strip sample according to Embodiment 1.

DESCRIPTION OF THE EMBODIMENTS

With reference to the embodiments, the invention will be further described in detail below in connection with the drawing.

Twenty embodiment alloys and two reference alloys (brass C28000 and tin phosphor bronze C51900) are selected, and the added elements are added to a melting furnace according to their respective contents, and the semi-continuous casting is carried out to obtain 170 mm×320 mm ingots at a casting temperature of 1150° C.

Other major preparation process parameters are:

Hot rolling: heating to 780° C., holding the temperature for 5 hours, and hot rolling to 16.5 mm;

Face milling: milling upper and lower faces to 15 mm;

Primary cold rolling: cold rolling to 2 mm from 15 mm;

Primary aging: aging at 550° C., and holding the temperature for 6 hours;

Secondary cold rolling: cold rolling to 0.35 mm from 2 mm;

Secondary aging: aging at 380° C., and holding the temperature for 8 hours;

Third cold rolling: cold rolling to 0.2 mm from 0.35 mm;

Low-temperature annealing: annealing at 210° C., and holding the temperature for 6 hours, thus obtaining strip samples.

For the prepared strip samples of 20 embodiment alloys and 2 reference alloys, mechanical properties, electrical conductivity, stress relaxation resistance and bending workability are respectively tested.

The room temperature tensile test is carried out in accordance with GB/T 228.1-2010 Metallic Materials-Tensile Tests Part 1: Room Temperature Test Method on an electronic universal mechanical property test machine, using 12.5 mm wide strip end samples, with a tensile speed of 5 mm/Min.

The electrical conductivity test is carried out in accordance with GB/T 3048.2-2007 Wires and Cables-Electrical Property test methods Part 2: Resistivity Tests for Metallic Materials, where the test instrument used is a ZFD microcomputer bridge DC resistance tester, with samples being 20 mm wide and 500 mm long.

The stress relaxation resistance test is carried out in accordance with JCBA T309: 2004 Bending Stress Relaxation Test Methods for Copper and Copper Alloys, where samples which are 10 mm wide and 100 mm long are taken parallel to the rolling direction, the initial loading stress value is 50% of 0.2% yield strength, the test temperature is 150° C., the test time is 1000 h.

The bending property test is carried out on a bending test machine in accordance with GBT 232-2010 Metallic Materials-Bending Test Methods, with samples being 5 mm wide and 50 mm long.

The composition and property test results of Embodiments and references are shown in Table 1. A TEM photograph of the strip sample in Embodiment 1 is shown in FIG. 1.

TABLE 1

Composition and property test results of Embodiments and references

| No. | Element content/wt % | | | | | | The percentage of NiSi phase precipitates having a particle diameter of 50 nm or less in the total amount of the NiSi phase precipitates/% | Property |
|---|---|---|---|---|---|---|---|---|
| | Cu | Sn | Ni | Si | Zn | Optional element | | Yield strength/MPa |
| Embodiment 1 | 80.11 | 1.52 | 1.33 | 0.33 | Balance | | 89 | 657 |
| Embodiment 2 | 85.01 | 0.49 | 1.01 | 0.22 | | | 83 | 621 |
| Embodiment 3 | 86.54 | 0.73 | 1.68 | 0.54 | | 0.21Mg | 95 | 633 |
| Embodiment 4 | 87.75 | 2.09 | 1.61 | 0.36 | | | 76 | 686 |
| Embodiment 5 | 85.82 | 0.35 | 1.66 | 0.53 | | | 84 | 629 |
| Embodiment 6 | 83.44 | 2.28 | 2.05 | 0.44 | | | 91 | 721 |
| Embodiment 7 | 82.06 | 1.02 | 1.28 | 0.31 | | | 87 | 657 |
| Embodiment 8 | 88.18 | 1.59 | 0.87 | 0.21 | | 0.05Cr | 91 | 642 |
| Embodiment 9 | 89.35 | 0.87 | 2.23 | 0.61 | | | 87 | 622 |
| Embodiment 10 | 91.52 | 1.97 | 1.79 | 0.51 | | | 78 | 655 |
| Embodiment 11 | 86.02 | 2.52 | 1.76 | 0.39 | | | 79 | 625 |
| Embodiment 12 | 82.93 | 0.51 | 1.04 | 0.11 | | | 76 | 654 |
| Embodiment 13 | 85.55 | 1.53 | 1.92 | 0.43 | | | 84 | 674 |
| Embodiment 14 | 90.22 | 0.63 | 1.52 | 0.36 | | | 91 | 636 |
| Embodiment 15 | 93.79 | 3.61 | 1.23 | 0.32 | | | 87 | 646 |
| Embodiment 16 | 94.89 | 1.26 | 0.82 | 0.83 | | | 91 | 643 |
| Embodiment 17 | 88.85 | 2.69 | 1.57 | 0.31 | | | 89 | 745 |
| Embodiment 18 | 88.07 | 1.22 | 2.62 | 0.58 | | 0.001B | 83 | 736 |
| Embodiment 19 | 91.43 | 0.08 | 2.53 | 0.48 | | 0.16Mg | 95 | 667 |
| Embodiment 20 | 86.65 | 1.51 | 3.71 | 0.36 | | 0.01Re | 76 | 643 |
| C28000 | 61.8 | | | | Balance | | | 430 |
| C51900 | Balance | 5.84 | | | | 0.12 | | 612 |

| No. | Property | | | |
|---|---|---|---|---|
| | Ductility/% | Electrical conductivity/% IACS | Stress relaxation resistance (Residual stress/%) | Bending 90°, BW, R/t |
| Embodiment 1 | 5 | 25.7 | 76 | 2 |
| Embodiment 2 | 5 | 31.6 | 80 | 1 |
| Embodiment 3 | 5 | 29.8 | 83 | 1 |
| Embodiment 4 | 3 | 24.5 | 78 | 2 |
| Embodiment 5 | 5 | 30.9 | 79 | 2 |
| Embodiment 6 | 3 | 23.1 | 76 | 2 |
| Embodiment 7 | 3 | 26.9 | 81 | 2 |
| Embodiment 8 | 3 | 24.9 | 75 | 1 |
| Embodiment 9 | 4 | 30.1 | 81 | 1 |
| Embodiment 10 | 4 | 31.3 | 82 | 2 |
| Embodiment 11 | 4 | 25.9 | 83 | 1 |
| Embodiment 12 | 3 | 27.7 | 75 | 2 |
| Embodiment 13 | 3 | 24.6 | 82 | 2 |
| Embodiment 14 | 3 | 35.7 | 80 | 1 |
| Embodiment 15 | 4 | 21.7 | 76 | 1 |
| Embodiment 16 | 4 | 23.2 | 81 | 2 |
| Embodiment 17 | 3 | 25.7 | 72 | 2 |
| Embodiment 18 | 3 | 23.8 | 75 | 2 |
| Embodiment 19 | 5 | 36.8 | 83 | 1 |
| Embodiment 20 | 3 | 28.6 | 81 | 2 |
| C28000 | 5 | 23.2 | 32 | 4 |
| C51900 | 4 | 14 | 64 | 2 |

What is claimed is:

1. A precipitation-strengthened copper alloy, comprising the following components in percentage by weight: 85.01 wt %-91.43 wt % of Cu, 0.05 wt %-4.0 wt % of Sn, 0.01 wt %-3.0 wt % of Ni, 0.01 wt %-1.0 wt % of Si, 5.32 wt %-19.93 wt % of Zn and unavoidable impurities, wherein matrix of the copper alloy contains NiSi phase precipitates, and in the matrix of the copper alloy the amount of NiSi phase precipitates having a particle diameter of 50 nm or less accounts for 75% or above of the total amount of the NiSi phase precipitates, wherein a X-ray diffraction intensity of a crystal face {111}, having a rolled surface within a range of $0<2\theta<90°$, of a strip of the copper alloy is denoted as $I_{\{111\}}$, a X-ray diffraction intensity of a crystal face {200} is denoted as $I_{\{200\}}$, a X-ray diffraction intensity of a crystal face {220} is denoted as $I_{\{220\}}$, and a X-ray diffraction intensity of a crystal face {311} is denoted as $I_{\{311\}}$, and $I_{\{111\}}$, $I_{\{200\}}$, $I_{\{220\}}$, and $I_{\{311\}}$ satisfy: $0.5<(I_{\{111\}}+I_{\{220\}})/(I_{\{200\}}+I_{\{300\}}<10$.

2. The precipitation-strengthened copper alloy according to claim 1, wherein the copper alloy further comprises the components in percentage by weight: 0.01 wt %-2.0 wt % of Co.

3. The precipitation-strengthened copper alloy according to claim 1, wherein the copper alloy further comprises the components in percentage by weight: 0.01 wt %-2.0 wt % of Fe and/or 0.001 wt %-1.0 wt % of P.

4. The precipitation-strengthened copper alloy according to claim 3, wherein the copper alloy further comprises the components in percentage by weight: at least one element of Mg, B, Re, Cr, and Mn in a total amount of not more than 2.0 wt %, wherein 0.005 wt %-1.5 wt % of Mg, 0.0005 wt %-0.3 wt % of B, 0.0001 wt %-0.1 wt % of Re, 0.01 wt %-1.5 wt % of Cr, and 0.001 wt %-0.8 wt % of Mn.

5. The precipitation-strengthened copper alloy according to claim 1, wherein a strip of the copper alloy has a yield strength of 600 MPa or above and an electrical conductivity of 20% IACS or above.

6. The precipitation-strengthened copper alloy according to claim 1, wherein a 90° bending workability of a strip of the copper alloy is as follows: a value of R/t in the GW direction is less than or equal to 1, and a value of R/t in the BW direction is less than or equal to 2.

7. The precipitation-strengthened copper alloy according to claim 4, wherein the copper alloy further comprises the components in percentage by weight: 0.01 wt %-2.0 wt % of Fe and/or 0.001 wt %-1.0 wt % of P.

* * * * *